United States Patent [19]

Dickakian

[11] 4,414,095

[45] Nov. 8, 1983

[54] MESOPHASE PITCH USING STEAM CRACKER TAR (CF-6)

[75] Inventor: Ghazi Dickakian, Scotch Plains, N.J.

[73] Assignee: Exxon Research and Engineering Co., Florham Park, N.J.

[21] Appl. No.: 273,200

[22] Filed: Jun. 12, 1981

[51] Int. Cl.[3] ..... C10C 1/20; C10C 3/00; D01F 9/12; C01F 9/00

[52] U.S. Cl. ..... 208/44; 423/447.2; 423/447.4; 423/447.6; 423/449

[58] Field of Search ..... 208/44; 423/447.2, 447.4, 423/447.6, 449.0

[56] References Cited

U.S. PATENT DOCUMENTS

| | | | |
|---|---|---|---|
| 2,864,760 | 12/1958 | Croy | 208/44 |
| 3,200,062 | 8/1965 | Britton | 208/44 |
| 3,373,101 | 3/1968 | Folkins et al. | 208/44 |
| 3,490,586 | 1/1970 | Taisle | 208/44 |
| 3,692,663 | 9/1972 | Ueda et al. | 208/44 |
| 3,721,658 | 3/1973 | Dickakian | 526/221 |
| 3,970,542 | 7/1976 | Bogertman | 208/44 |
| 4,086,156 | 4/1978 | Dickakian | 208/44 |
| 4,176,043 | 11/1979 | van Eijk | 208/44 |
| 4,208,267 | 6/1980 | Diefendorf et al. | 208/22 |
| 4,219,404 | 8/1980 | Dickakian | 208/44 |

*Primary Examiner*—Delbert E. Gantz
*Assistant Examiner*—Helane E. Maull
*Attorney, Agent, or Firm*—Joseph J. Dvorak

[57] ABSTRACT

A feedstock for carbon artifact manufacture is obtained from a steam cracker tar by heat soaking the steam cracker tar or a vacuum stripped steam cracker tar with a polycondensed aromatic oil thereby providing a pitch suitable for carbon artifact manufacture.

10 Claims, No Drawings

MESOPHASE PITCH USING STEAM CRACKER TAR (CF-6)

FIELD OF THE INVENTION

This invention is directed toward a process for preparing a pitch useful in carbon artifact manufacture, especially carbon fiber manufacture. Indeed, this invention is more particularly directed toward the conversion of a steam cracker tar into a carbon fiber precursor.

BACKGROUND OF THE INVENTION

As is well known, carbon artifacts have been made by pyrolyzing a wide variety of organic materials. Indeed, one carbon artifact of particularly important commercial interest today is carbon fiber. Hence, specific reference is made herein to carbon fiber technology. Nevertheless, it should be appreciated that this invention has applicability to carbon artifact manufacturing generally, and most particularly, to the production of shape carbon articles in the form of filaments, yarns, films, ribbons, sheets and the like.

Referring now in particular to carbon fibers, suffice it to say, that the use of carbon fibers in reinforcing plastic and metal matrices has gained considerable commercial acceptance where the exceptional properties of the reinforcing composite materials, such as their higher strength to weight ratio clearly offset the generally higher costs associated with preparing them. It is generally accepted that large scale use of carbon fibers as a reinforcing material would gain even greater acceptance in the marketplace if the costs associated with the formation of the fibers could be substantially reduced. Thus, formation of carbon fibers for relatively inexpensive carbonaceous pitches has received considerable attention in recent years.

Many carbonaceous pitches are known to be converted at the early stage of carbonization to a structurally ordered optically anisotropic spherical liquid crystal called mesophase. The presence of this ordered structure prior to carbonization is considered to be a significant determinant of the fundamental properties of a carbon artifact made from such a carbonaceous pitch. Indeed, the ability to generate high optical anisotropicity during processing is accepted, particularly in carbon fiber production, as a prerequisite for the formation of high quality products. Thus, one of the first requirements of a feedback material suitable for carbon artifact manufacture, and particularly for carbon fiber production, is its ability to be converted to a highly optically anisotropic material.

In addition to being able to develop highly ordered structures, suitable feedstocks for carbon artifact manufacture, and in particular carbon fiber manufacture, should have relatively low softening points and low viscosity rendering them suitable for being deformed and shaped into desirable articles. Thus, in carbon fiber manufacture a suitable pitch which is capable of generating the requisite highly ordered structure also must exhibit sufficient viscosity for spinning. Unfortunately, many carbonaceous pitches have relatively high softening points. Indeed, incipient coking frequently occurs in such materials at temperatures where they have sufficient viscosity for spinning. The presence of coke, however, or other infusible materials and/or undesirable high softening point components generated prior to or at the spinning temperatures are detrimental to fiber processability and are believed to be detrimental to fiber product quality.

As is well known, pitches have been prepared from the residues and tars obtained from steam cracking of gas oil or naphtha. In this regard, see, for example, U.S. Pat. No. 3,721,658 and U.S. Pat. No. 4,086,156. These tarry products typically are composed of alkyl substituted polynuclear aromatics. Indeed, the steam cracker tars have relatively high levels of paraffinic carbon atoms, for example, in the range of about 30 atom % to about 35 atom % paraffinic carbon atoms, the presence of which tends to be detrimental to the formation of a suitable anisotropic pitch for carbon fiber production. Additionally, steam cracker tars contain asphaltenes in relatively large quantities, for example, in the range of about 20 wt. % to about 30 wt. %. Asphaltenes, as is well known, are solids which are insoluble in paraffinic solvents. The asphaltenes on carbonization tend to form isotropic material, rather than anisotropic material, and hence its presence in steam cracker tars tends to be detrimental in the formation of anisotropic pitch from such steam cracker tars. Additionally, asphaltenes present in steam cracker tars have high coking characteristics, a property detrimental to carbon artifact manufacture.

As mentioned above, many isotropic carbonaceous pitch materials can be converted to an optically anisotropic phase by thermal treatment of the isotropic material. In the instance of steam cracker tars, however, thermal heat treatment of the steam cracker tars provides an isotropic pitch component which have a softening point which is undesirably high, for example, greater than 375° C., for carbon artifact manufacture, particularly for carbon fiber manufacture. In other words, the thermal generation of pitches from steam cracker tars has not, heretofore, resulted in the formation of pitches having high optical anisotropicity, e.g., greater than 70%, and low softening points and viscosities, e.g., below about 325° C. and 2000 poise (at 360° C.).

SUMMARY OF THE INVENTION

It has now been discovered that the rate of formation and softening point of the carbon fiber precursors produced on heat soaking steam cracker tars are dependent upon the type and quantity of oil present in the tar during heat soaking thereof. Indeed, it has been discovered that the presence of low molecular weight pitch oil during the heating of steam cracker tars or vacuum stripped steam cracker tars produce beneficial effects in the types of pitch produced from the steam cracker tar.

Simply stated, the present invention contemplates a process for preparing a feedstock for carbon artifact manufacture comprising adding a polycondensed aromatic oil or pitch containing such oil to a steam cracker tar or a vacuum stripped steam cracker tar to provide a mixture and thereafter heat soaking the mixture for a time sufficient to provide a pitch suitable for carbon artifact manufacture. For example, a pitch oil in an amount ranging from about 5 weight percent to about 60 wt. % is added to a steam cracker tar or a vacuum stripped steam cracker tar to provide a mixture which is heat soaked at temperatures generally in the range of about 350° C. to about 430° C. and pressures ranging generally from about 760 mm Hg to about 200 psig, and for times ranging from 30 minutes to about 5 hours thereby providing a pitch suitable for carbon artifact manufacture.

Full appreciation of all of the ramifications of the present invention will be more readily understood upon reading of the detailed description which follows.

DETAILED DESCRIPTION

The steam cracker tar which is used as a starting material in the process of the present invention is defined as the bottoms product obtained when steam cracking gas oil, naphtha or mixtures of such petroleum hydrocarbons are heated at temperatures of from about 700° C. to about 1,000° C. Typical processes are the steam cracking of gas oil and naphtha, preferably at temperatures of 800° C. to 900° C., with a 50 to 70% conversion to $C_3$ olefin and lighter hydrocarbons during relatively short times of the order of seconds followed by stripping at a temperature of about 200° C. to 250° C. to obtain the tar as a bottoms product. The gas oil, of course, is the liquid petroleum distillate with a viscosity and boiling range between kerosene and lubricating oil and having a boiling range from about 200° C. to 400° C. Examples of gas oils are vacuum gas oils, light gas oil and heavy gas oil. Naphtha is a generic term for refined, partly refined or unrefined petroleum products in liquid products of natural gas not less than 10% of which distill below 175° C. and not less than 95% of which distill below 240° C. when subjected to distillation according to the standard method referred to as ASTM Test Method D-86.

Obviously, the characteristics of a steam cracker tar vary according to the feed in the steam cracking plant; nonetheless steam cracker tars do possess certain general characteristics or range of properties.

The specifications for a typical steam cracking tar that is suitable in the present invention is given in Table 1 below.

TABLE 1

Physical and Chemical Characteristics of Steam Cracker Tars from Naphtha, Gas Oil and Desulfurized Gas Oil Cracking

| | SCT from Naphtha Cracking | SCT from Gas Oil Cracking Ex (1) | SCT from Gas Oil Cracking Ex (2) | SCT from Desulfurized Gas Oil Cracking |
|---|---|---|---|---|
| 1. Physical Characteristics | | | | |
| Viscosity cst at 210° F. | 13.9 | 19.3 | 12.4 | 25.0 |
| Coking Value at 550° F. (%) | 12 | 16 | 24 | 25 |
| Toluene Insolubles (%) | 0.200 | 0.200 | 0.250 | 0.100 |
| n-Heptane Insolubles (%) | 3.5 | 16 | 20 | 15 |
| Pour Point (°C.) | +5 | +5 | −6 | +6 |
| Ash (%) | 0.003 | 0.003 | 0.003 | 0.003 |
| 2. Chemical Structure (by carbon and proton NMR) | | | | |
| Aromatic Carbon (atom %) | 65 | 72 | 71 | 74 |
| Aromatic Protons (%) | 34 | 42 | 42 | 38 |
| Benzylic Protons (%) | 40 | 44 | 46 | 47 |
| Paraffinic Protons (%) | 25 | 14 | 12 | 15 |
| Carbon/Hydrogen Atomic Ratio | 0.942 | 1.011 | 1.079 | 1.144 |
| 3. Elemental Analysis | | | | |
| Carbon (wt %) | 91.60 | 90.31 | 88.10 | 90.61 |
| Hydrogen (wt %) | 8.10 | 7.57 | 6.80 | 6.60 |
| Nitrogen (wt %) | 0.15 | 0.10 | 0.15 | 0.18 |
| Oxygen (wt %) | 0.20 | 0.22 | 0.18 | 0.19 |
| Sulfur (wt %) | 0.06 | 1.5 | 4.0 | 1.5 |
| Iron (ppm) | 0.003 | 0.003 | — | — |
| Vanadium (ppm) | 0.000 | 0.001 | — | — |
| Silicon (ppm) | 0.001 | 0.00 | — | — |
| Number Average Molecular Wt. | 295 | 300 | 305 | 315 |

The diluent oil used in the process of the present invention is obtained from the bottoms product generated in the thermal and catalytic cracking of petroleum distillates, including hydrodesulfurized residuals distilled and cracked crude oils. Indeed, the preferred pitch oil of the present invention consists of polycondensed aromatic compounds having average molecular weights below about 300 and having a boiling point in the range of about 400° C. to about 600° C. at 760 mm Hg.

As with the steam cracker tars so too will the characteristics of the pitch oil vary within a reasonable range depending upon the source of crude, cracking conditions and the like.

Typical physical, elemental and chemical characteristics of the preferred pitch oil used in the practice of the present invention are given in Table 2 below.

TABLE 2

Chemical and Physical Characteristics of Diluent Pitch Oil

| | Range |
|---|---|
| Physical Characteristics | |
| Specific gravity @ 15° C. | .95–1.1 |
| Asphaltene content (%) (n-Heptane insolubles) | Nil–1.5 |
| Ash content | Nil |
| Coking value at 550° C. (%) | 1–6 |
| Average molecular weight | 200–300 |
| Chemical Structure (by carbon and proton NMR) | |
| Aromatic carbon (atom %) | 78–88 |
| Aromatic protons (%) | 50–60 |
| Benzylic protons (%) | 37–38 |
| Paraffinic proton (%) | 2–12 |
| Elemental Analysis | |
| Carbon/hydrogen atomic ratio | 1.35–1.45 |
| Thermal Analysis (TGA in Nitrogen) | |
| Weight loss at 200° C. (%) | 0.5–1.0 |
| Weight loss at 250° C. (%) | 2.0–3.0 |
| Weight loss at 350° C. (%) | 45–51.5 |
| Weight loss at 450° C. (%) | 95–98.0 |

As previously indicated, it has been discovered that in heat soaking steam cracker tars or vacuum stripped steam cracker tars at temperatures in the range from about 350° C. to about 430° C. pitches are obtained which contain high melting substances which are detrimental in carbon artifact manufacture, particularly in carbon fiber manufacture. In contrast thereto, when steam cracker tars or vacuum stripped steam cracker tars are heated at temperatures in the range from about 350° C. to about 430° C. in the presence of pitch oil as herein defined, a pitch having a relatively low softening point and high optical anisotropicity suitable for carbon artifact manufacture is obtained. Therefore, according to one embodiment of the present invention, a pitch oil is first added to a steam cracker tar or a vacuum stripped steam cracker tar to provide a mixture which is subsequently heat soaked. The amount of pitch oil added to the steam cracker tar or vacuum stripped steam cracker tar generally will be in the range of about 5 wt. % to 60 wt. % based on the total weight of the mixture, and preferably the amount of oil will be in the range of about 30 wt. % to 50 wt. %. Since commercially available pitches such as Ashland 240 contains 28 wt. % of an oil of the type useful in the process of the present invention, optionally a petroleum pitch containing the pitch oil, such as A240 or the pitch obtained by the process of U.S. Pat. No. 4,219,404, may be added to the steam cracker tar or vacuum stripped steam cracker tar. If the whole pitch is to be used then generally from about 30 wt. % to 50 wt. % of the pitch will be added to the steam cracker tar or vacuum stripped steam cracker tar thereby providing for an oil content ranging from around 8 wt. % to 14 wt. % in the total mixture.

The vacuum stripped steam cracker tar, of course, can be obtained by subjecting the steam cracker tar to temperatures generally in the range of from about 150° C. to 430° C. and pressures below atmospheric pressure and generally in the range from about 1 to 10 mm Hg to remove at least a portion of the low boiling materials present in the steam cracker tar. Typically, from about 10 to 50 wt. % of the low boiling substance present in the steam cracker tar is removed to obtain a suitable vacuum strip steam cracker tar.

After having added the pitch oil or pitch containing pitch oil to the steam cracker tar and/or vacuum stripped steam cracker tar, the resultant mixture is heat soaked at temperatures ranging generally from about 350° C. to 430° C., and preferably at temperatures ranging from about 370° C. to 390° C. for 0.5 to 1.0 hour under pressures ranging generally from about atmospheric pressure to 200 psig, thereafter providing a pitch material.

It will be appreciated that if the steam cracker tar is used as the starting material without first vacuum stripping the steam cracker tar, then it is advantageous after heat soaking with the pitch oil to vacuum strip the resultant material. The conditions of such post-vacuum stripping is the same as the conditions employed in first obtaining a vacuum stripped steam cracker tar for heat soaking in the presence of a pitch oil as described above.

In yet another embodiment of the present invention, the vacuum stripped steam cracker tar and pitch oil are heat soaked at temperatures ranging from about 350° C. to about 430° C. for 0.5 to 1.0 hour in the presence of a dealkylation catalyst selected from heavy metal halides, Lewis acids and Lewis acid salts such as $AlCl_3$, $ZnCl_2$, $BF_3$, $FeCl_3$ and the like. Typically from about 0.025 wt. % to about 1.0 wt. % and preferably from about 0.25 wt. % to about 0.50 wt. % based on the total weight of the mixture will be employed.

In utilizing the pitch prepared from the steam cracker tar in accordance with the present invention, particular reference is now made to copending application Ser. No. 29,760, filed Apr. 13, 1979 which application is incorporated herein by reference. Basically, the heat soaked pitch is fluxed, i.e., it is treated with an organic liquid in the range, for example, of from about 0.5 parts by weight of organic liquid per weight of pitch to about 3 parts by weight of fluxing liquid per weight of pitch, thereby providing a fluid pitch having substantially all the quinoline insoluble material suspended in the fluid in the form of a readily separable solid. The suspended solid is then separated by filtration or the like, and the fluid pitch is then treated with an antisolvent compound so as to precipitate at least a substantial portion of the pitch free of quinoline insoluble solids.

The fluxing compounds suitable in the practice of this invention include tetrahydrofuran, toluene, light aromatic gas oil, heavy aromatic gas oil, tetralin and the like.

As will be appreciated, any solvent system, i.e., a solvent or mixture of solvents which will precipitate and flocculate the fluid pitch, can be employed herein. However, since it is particularly desirable in carbon fiber manufacture to use that fraction of the pitch which is readily convertible into a deformable, optically anisotropic phase such as disclosed in U.S. Ser. No. 903,172, filed May 5, 1978 (incorporated herein by reference), the solvent system disclosed therein is particularly preferred for precipitating the desired pitch fraction. Typically, such solvent or mixture of solvents includes aromatic hydrocarbons, such as benzene, toluene, xylene and the like and mixtures of such aromatic hydrocarbons with aliphatic hydrocarbon such as toluene-heptane mixtures. The solvents or mixtures of solvents typically will have a solubility parameter of between 8.0 and 9.5, and preferably between about 8.7 and 9.2 at 25° C. The solubility parameter, $\gamma$, of a solvent or mixture of solvents is given by the expression $$\gamma = \left(\frac{H_v - RT}{V}\right)^{\frac{1}{2}}$$

where $H_v$ is the heat of vaporization of the material;

R is the molar gas constant;

T is the temperature in °K.; and

V is the molar volume.

In this regard, see, for example, J. Hildebrand and R. Scott, "Solubility of Non-Electrolytes," 3rd Edition, Reinhold Publishing Company, New York (1949), and "Regular Solutions," Prentice Hall, New Jersey (1962). Solubility parameters at 25° C. for hydrocarbons and commercial $C_6$ to $C_8$ solvents are as follows: benzene, 8.2; toluene, 8.9; xylene, 8.8; n-hexane, 7.3; n-heptane, 7.4; methylcyclohexane, 7.8; bis-cyclohexane, 8.2. Among the foregoing solvents, toluene is preferred. Also, as is well known, solvent mixtures can be prepared to provide a solvent system with the desired solubility parameter. Among mixed solvent systems, a mixture of toluene and heptane is preferred having greater than about 60 volume % toluene, such as 60% toluene/40% heptane and 85% toluene/15% heptane.

The amount of solvent employed will be sufficient to provide a solvent insoluble fraction capable of being thermally converted to greater than 75% of an optically anisotropic material in less than 10 minutes. Typically the ratio of solvent to pitch will be in the range of about 5 millimeters to about 150 millimeters of solvent to a gram of pitch. After heating the solvent, the solvent insoluble fraction can be readily separated by techniques such as sedimentation, centrifugation, filtration and the like. Any of the solvent insoluble fraction of the pitch prepared in accordance with the process of the present invention is eminently suitable for carbon fiber production.

A more complete understanding of the process of this invention can be obtained by reference to the following examples which are illustrative only and are not meant to limit the scope thereof which is fully disclosed in the hereinafter appended claims.

EXAMPLE 1

A steam cracker tar was distilled using a 15/5 stainless steel high vacuum distillation unit. 12 kg of a steam cracker tar was introduced into the distillation pot, the pressure was reduced to 250–500 microns. The tar was then heated under reduced pressure with agitation. The tar was then fractionated into several fractions. The distillation data is given in Table 3 below.

TABLE 3

| Vacuum Stripping of Steam Cracker Tar | | | |
|---|---|---|---|
| Fraction No. | Operating Pressure (Microns) | Vapor Temperature (°C.) (At 760 mm Hg) | Wt. (%) Fraction |
| — | 200 | 243 (IBP) | — |
| 1 | 120 | 243–335 | 10.0 |
| 2 | 80 | 335–363 | 9.8 |
| 3 | 80 | 363–390 | 10.1 |
| 4 | 90 | 390–415 | 11.2 |
| 5 | — | 415+ | 58.0 |

The fraction having a boiling point greater than 415° C. is the vacuum-stripped steam cracker tar.

EXAMPLE 2

A commercially available petroleum pitch, Ashland 240, was vacuum stripped using a 15/5 high vacuum distillation unit as in Example 1.

12 kg of the Ashland pitch was introduced into the distillation pot, and the pressure in the unit was reduced to 250–700 microns. The pitch was then heated at around 200° C. and agitation started.

The pitch was heated continuously until distillation started. Several fractions varying in their boiling point were separated. The distillation data is given in Table 4 below.

TABLE 4

| Vacuum Distillation of A240 | | | |
|---|---|---|---|
| Fraction No. | Pressure (Microns) | Vapor Temperature (°C.) (At 760 mm Hg) | Wt. (%) Fraction |
| — | 520 | 376 (IBP) | — |
| 1 | 580 | 376–416 | 3.9 |
| 2 | 600 | 416–450 | 7.2 |
| 3 | 680 | 450–488 | 4.9 |
| 4 | 780 | 488–504 | 10.4 |
| Total distillate | | — | 26.4 |

Fractions 3 and 4 above were combined for use in the experiments which follow.

EXAMPLES 3, 4 AND 5

To 70 parts by weight of the vacuum stripped steam cracker tar obtained in Example 1 was added 30 parts by weight of the A240 oil from Example 2, and the resultant mixture was heat soaked at 390° C. for 1 hour under an atmosphere of nitrogen with continuous mechanical agitation. When heat soaking was completed, the mixture was cooled to room temperature under nitrogen.

The toluene insolubles fraction of the pitch was separated by the following procedure.

(1) 40 grams of crushed sample were mixed with 40 grams of toluene and the mixture refluxed for 1 hour. After cooling to about 95° C., the mixture was filtered using a 10 to 15 micron fritted glass filter.

(2) The filtrate was then diluted with toluene in a 1 to 8 ratio and after standing, the precipitated solids were separated by filtration using a 10 to 15 micron fritted glass filter.

(3) The filter cake was washed with 80 milliliters of toluene, reslurried and mixed for 4 hours at room temperature with 120 milliliters of toluene filter using a 10 to 15 micron glass filter.

(4) The filter cake was washed with 80 milliliters of toluene followed by a wash with 80 milliliters of heptane, and finally the solid was dried at 120° under reduced pressure (28–30 in Hg) for 24 hours.

The optical anisotropicity of the isolated solvent insoluble pitch was determined by first heating the pitch to its softening point, and then, after cooling, placing a sample of the pitch on a slide with Permount, a histological medium sold by the Fischer Scientific Company, Fairlawn, N.J. A slip cover was placed over the slide and by rotating the cover under hand pressure, the mounted sample was crushed to a powder and evenly dispersed on the slide. Thereafter, the crushed sample was viewed under polarized light at a magnification factor of 200× and the percent optical anisotropicity was estimated. In all instances, the optical anisotropicity was greater than 75%.

The melting point of the isolated pitch was determined by charging about 20–30 mg of the powdered samples into an NMR sample tube under nitrogen. The tube was flushed with nitrogen and sealed. Thereafter, the tube was placed in a metal block apparatus, heated and the melting point was considered to be the point where the powder agglomerated into a solid mass.

In one experiment (Example 5), the vacuum stripped steam cracker was heat soaked without pitch oil. The experimental details are set forth in Table 5 below.

TABLE 5

| | Feed Composition | | Heat Soaking | | Toluene Insolubles Characteristics | |
|---|---|---|---|---|---|---|
| Example | VS-SCT* (%) | Ashland Oil (%)** | Temp. (°C.) | Time (hrs) | Wt. % | Melting Point (°C.) |
| 3 | 90 | 10 | 390 | 1.0 | 11.6 | 300/325 |
| 4 | 70 | 30 | 390 | 1.0 | 16.6 | 300/325 |
| 5 | 100 | 0 | 390 | 1.0 | 21.0 | 400+ |

*VS-SCT = Vacuum stripped steam cracker tar.
**From Example 2.

EXAMPLES 6 TO 8

In these examples, the procedure of Examples 3 to 5 is followed; however, 1.0 wt. % of anhydrous aluminum chloride was added to the mixture prior to heat soaking, and, in one example, Ashland pitch rather than pitch oil was used. Also, in one example (Example 8), the distillate fraction removed from the steam cracker tar was added back to provide a comparative run in the absence of pitch oil but in the presence of catalyst. The heating times and conditions and the results are set forth in Table 6.

TABLE 6

| Example | VS-SCT* (%) | Ashland (240%) | Pitch Oil** (%) | SCT Oil*** (%) | $AlCl_3$ (%) | Heat Soaking Temp (°C.) | Heat Soaking Time (hrs) | Toluene Insolubles Wt. % | Toluene Insolubles Melting Point (°C.) |
|---|---|---|---|---|---|---|---|---|---|
| 6 | 70 | — | 30 | — | 1.0 | 370 | 1.0 | 22 | 300–350 |
| 7 | 70 | 30 | — | — | 1.0 | 370 | 1.0 | 10 | 275–300 |
| 8 | 70 | — | — | 30 | 1.0 | 350 | 1.0 | 10.4 | 400+ |

*VS-SCT = Vacuum stripped steam cracker tar.
**From Example 2.
***SCT oil = Steam cracker tar oil from Example 1.

What is claimed is:

1. A process for preparing a pitch suitable for carbon fiber manufacture comprising:
   providing a steam cracker tar or a vacuum stripped steam cracker tar;
   adding a polycondensed aromatic pitch oil boiling in an approximate range of 400° C. to 600° C. to said steam cracker tar or vacuum stripped steam cracker tar to provide a mixture; and
   heat soaking said mixture at temperatures in the range of from about 350° C. to about 430° C. whereby a pitch suitable for carbon artifact manufacture is obtained.

2. The process of claim 1 wherein said polycondensed aromatic oil having a boiling point range of from about 400° C. to about 600° C. is added in amounts ranging from about 5 wt. % to about 60 wt. % based on the total mixture.

3. The process of claim 1 wherein said polycondensed aromatic oil having a boiling point range of from about 400° C. to about 600° C. is added in amounts ranging from about 30 wt. % to about 50 wt. % based on the total mixture.

4. The process of claim 2 or 3 including adding a dealkylation catalyst selected from heavy metal halides, Lewis acids and Lewis acid salts.

5. The process of claim 3 wherein the catalyst is $AlCl_3$.

6. The process of claim 1 including vacuum stripping said heat soaked mixture when a steam cracker tar is provided.

7. A process of preparing a pitch from a steam cracker tar comprising:
   providing a steam cracker tar;
   heating said steam cracker tar at temperatures ranging from about 150° C. to about 430° C. at reduced pressures for times sufficient to remove from about 10 wt. % to about 50 wt. % of low boiling substances in said tar thereby providing a vacuum stripped steam cracker tar;
   adding from about 5 wt. % to about 60 wt. % of an aromatic oil having a boiling point ranging from about 400° C. to about 600° C. to provide a mixture;
   heat soaking said mixture at temperatures ranging from about 350° C. to about 430° C. to provide a pitch.

8. The process of claim 6 wherein from about 0.025 wt. % to about 1.0 wt. % of $AlCl_3$ is added to the mixture prior to heat soaking.

9. A process for preparing a pitch suitable for carbon fiber manufacture comprising:
   providing a steam cracker tar;
   adding a polycondensed aromatic pitch oil boiling in an approximate range of 400° C. to 600° C. to said steam cracker tar to provide a mixture;
   heat soaking said mixture at temperatures in the range of from about 350° C. to about 430° C.; and
   vacuum stripping said heat soaked mixture.

10. The process of claim 9 wherein from about 0.025 wt. % to about 1.0 wt. % of $AlCl_3$ is added to the mixture prior to heat soaking.

* * * * *